United States Patent [19]

Winrow

[11] 3,975,728

[45] Aug. 17, 1976

[54] ELECTROMAGNETIC DISPLAYS WITH RESILIENTLY MOUNTED COMPONENTS

[75] Inventor: Donald Winrow, Weston, Canada

[73] Assignee: Ferranti-Packard Limited, Toronto, Canada

[22] Filed: Mar. 28, 1975

[21] Appl. No.: 563,227

[52] U.S. Cl. ..... 340/373; 340/366 E; 40/28 C

[51] Int. Cl.[2] ..... G08B 5/00

[58] Field of Search ..... 340/373, 366 R, 366 E; 40/28 R, 28 C

[56] References Cited

UNITED STATES PATENTS

| | | | |
|---|---|---|---|
| 3,025,512 | 3/1962 | Bloechl | 340/373 |
| 3,036,300 | 5/1962 | Knight | 340/373 |
| 3,074,060 | 1/1963 | Kadlec | 340/373 |
| 3,140,553 | 7/1964 | Taylor | 340/373 UX |

*Primary Examiner*—John W. Caldwell
*Assistant Examiner*—William M. Wannisky

[57] ABSTRACT

A rotatable element for a display element is constructed of an open ring which supports a display surface resiliently bent from its unstressed attitude and held in such position. The element is designed to be pivotally mountable on an axis generally parallel to the mean plane of the display surface.

The element is preferably magnetically operable by an exterior magnetic field and the element carries a magnet defining a field transverse to the pivotal axis.

The exterior field for the rotatable element is preferably provided by a coil wound core resiliently mounted on the support surface for the element.

The support surface provides brackets for location on each side of the element position and designed to receive a shaft mounting such elements.

9 Claims, 7 Drawing Figures

ELECTROMAGNETIC DISPLAYS WITH RESILIENTLY MOUNTED COMPONENTS

This invention relates to a rotatable element for use in magnetically operated, display or indicating devices.

The type of devices with which the development is used are those discussed in U.S. Pat. No. 3,140,553 dated July 14, 1964, U.S. Pat. No. 3,283,427 dated Nov. 8, 1966, U.S. Pat. No. 3,295,238 dated Jan. 3, 1967, U.S. Pat. No. 3,365,824 dated Jan. 30, 1968 and U.S. Pat. No. 3,303,494 dated Feb. 7, 1967.

In these patents are shown display or indicating devices using one or more pivotally mounted elements each having contrasting surfaces on opposite sides, and each having mounted for rotation therewith, a magnet having its magnetic axis transverse to the axis of rotation. Means for producing a magnetic field, exterior to the rotatable element is provided, being designed to controllably switch the field between two opposite or nearly opposite orientations to rotate the rotatable element through roughly 180° to display one or the other of its contrasting sides. The term 'roughly' 180° is used to cover the situations where due to the use of stops or bias the rotation limited to something of the order of 160° – 170°.

This invention relates to the construction of the rotatable element with associated elements of the display being shown for the sake of completeness.

In drawings which illustrate a preferred embodiment of the inventive disc and associated elements:

It is proposed to describe the mounting for the inventive disc and thereafter to describe the inventive disc itself.

Figure 1:
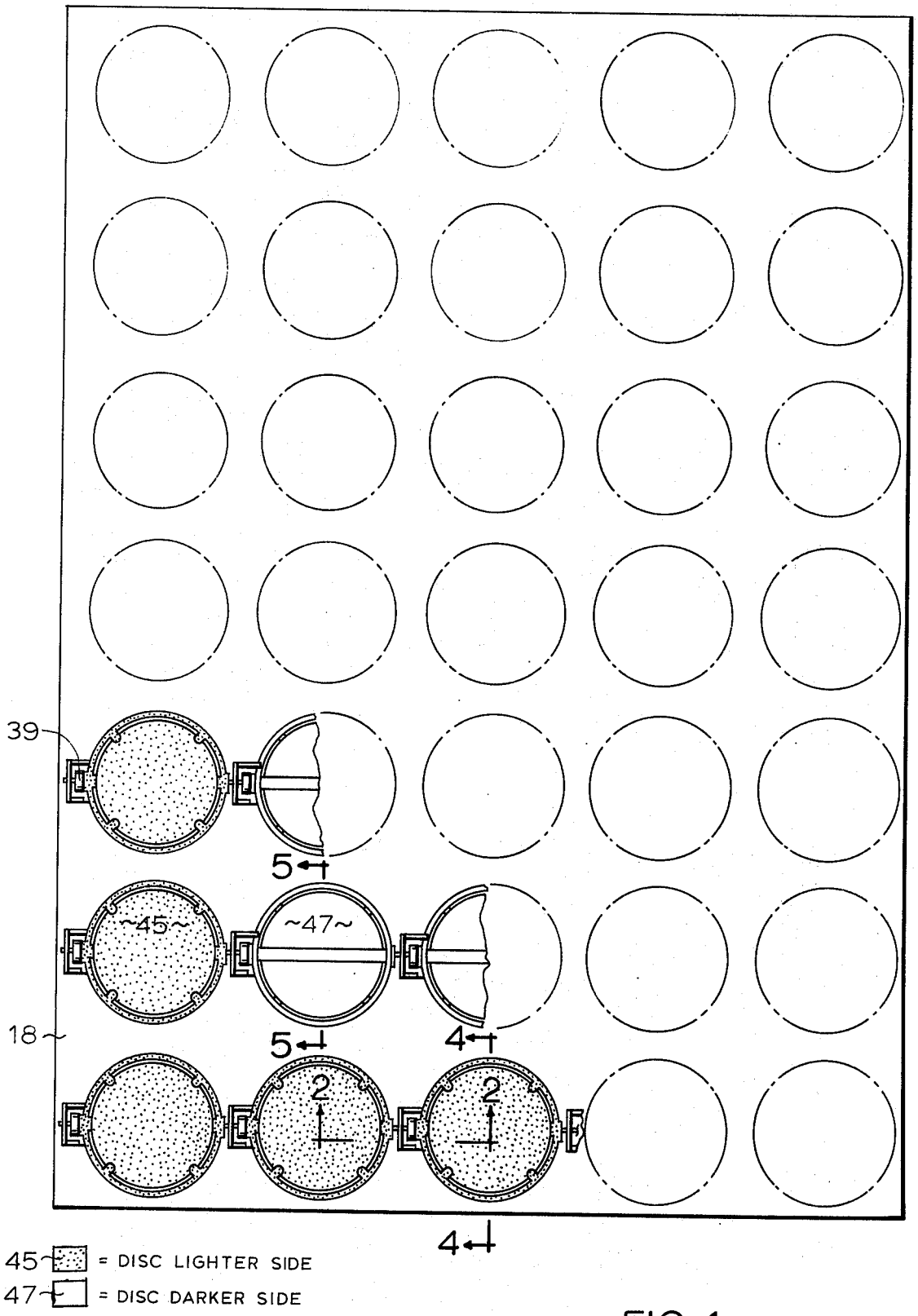
FIG. 1 shows a front view (i.e. a view looking in the viewing direction) of an array of magnetically actuable elements, being five elements wide and seven elements high.
Figure 2:
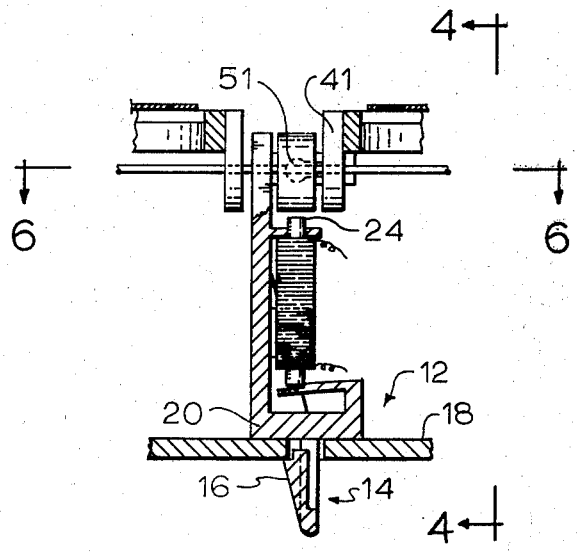
FIG. 2 shows a cross-section along the line 2—2 of FIG. 1.
Figure 3:
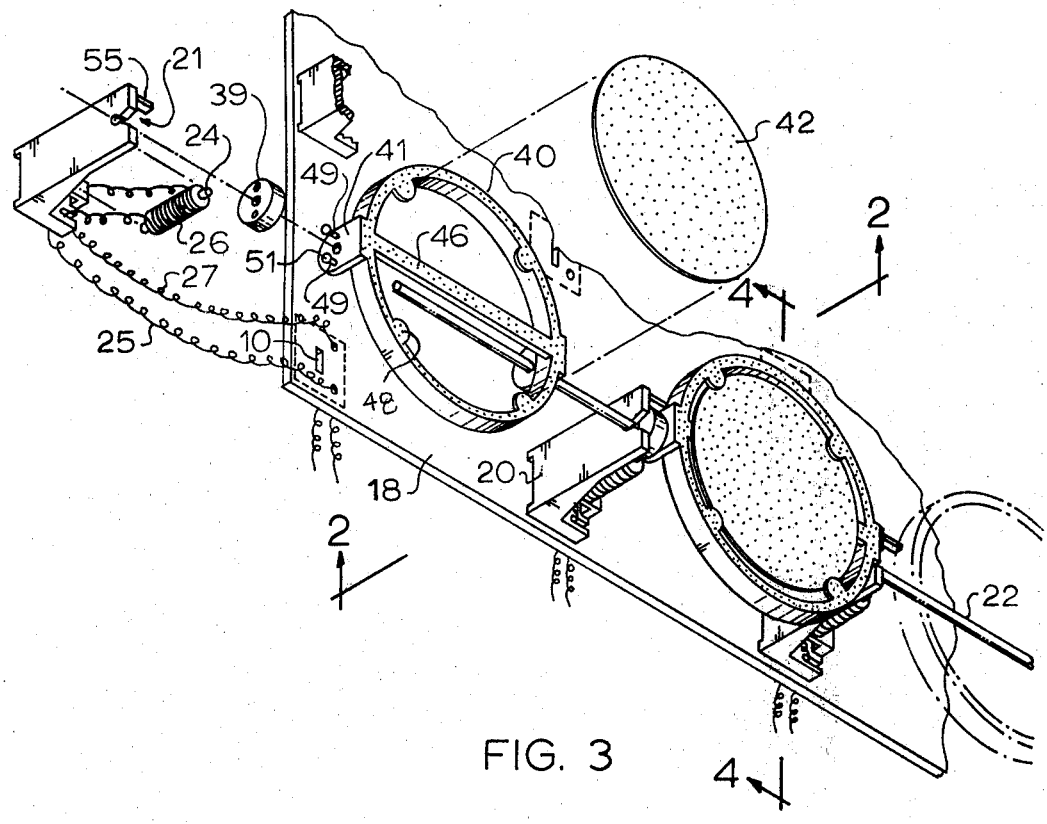
FIG. 3 is an exploded view of the left lower corner of the array as viewed in FIG. 1.

As shown the array of FIG. 1 as shown in FIG. 3 provides a bracket mounting slot 10 corresponding to each rotatable element and shaped to receive the mounting clip of a bracket 12. The mounting clip may be of any form allowing an easy attachment of the bracket. As shown the clip 14 preferably of plastic has a tapering extremity shaped for easy insertion in slot 10 and is shaped to provide a resiliently deflectable dog 16 which is moved inwardly during passage of the tapering extremity through the slot and after passage expands to bear on the rear of the array board 18 and to hold the bracket in position. The bracket 12 includes a base 20 designed to be held to the board in cooperation with the action of the dog 16 and to extend outwardly from the board to provide at the end of the bracket remote from the board an open ended slot 21 tapering toward the board and expanding at its inner end to receive the mounting shaft 22. The open ended slot is dimensioned and designed to expand receive the shaft 22 and snap thereonto to hold the shaft in position.

Thus a shaft 22 as shown may (after being threaded through the rotatable display elements as hereinafter described) be clipped in all the slots 21 of aligned brackets 12 in one row of the array, and the array will usually be provided with means (not shown) for anchoring and supporting the ends of each shaft 22.

The magnetic field forming member is mounted on the bracket by means to be described. The magnetic field forming member comprises a core 24 projecting from each end of an energizing coil 26 the latter having leads 25 and 27. In order that the coil 26 need only be pulsed instead of continuously energized, the core 24 is made of semi-permanently magnetizable material. By 'semi-permanently magnetizable material' is meant a material which, when magnetized in a given polarity, will retain that polarity without energizing current in the winding but which material may have its polarity reversed by a current of sufficient magnitude in the correct sense through the coil 26.

Figure 7:
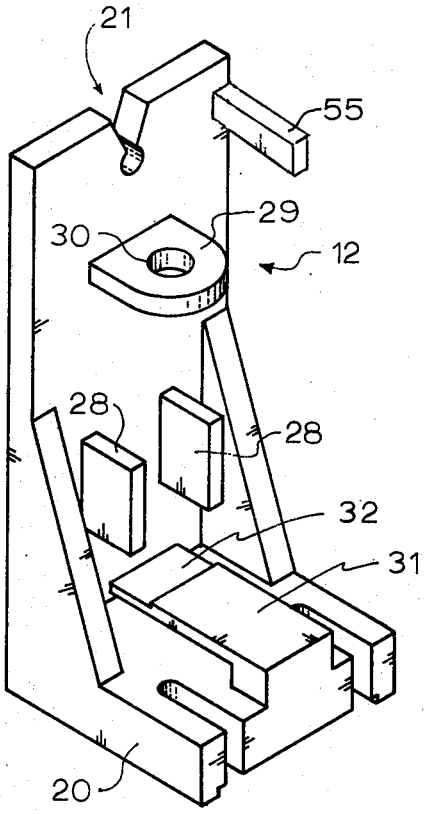
FIG. 7 shows the mounting bracket for the element.

As best shown in FIG. 7 the bracket 12 is provided with side plates 28 which retain the lateral movement of the coil, an outer plate 29 having a bore 30 to receive the outer end of the core 24 and a resilient cantilever member 31 designed to provide a platform 32 for supporting the inward end of the coil 24. The core 24 is mounted by inserting the outer end thereof in aperture 30. The lower end of the core is then pushed into position between the side plates 28 deflecting the cantilever member 31 downward until it is firmly held between the platform and the socket provided by the aperture 30.

The bracket 12 is designed to hold the outward, end of the core in close proximity to the locus of the magnet 39 on the rotating element.

The inventive disc operable on the aforesaid mounting will now be described:

In accord with the invention, there is provided a rotatable element wherein a frame, preferably a ring 40 is provided for pivotal mounting on a pivot shaft or bearings! In the preferred embodiment the ring 40 is provided with diametrically opposed ears 41 which extend transverselly to the plane defined by the general periphery of the ring.

The opposed ears 41 of each rotatable element are provided with aligned apertures 43 designed to loosely slidably receive the spindle 22 so that the rotatable element is free to rotate slidably on the spindle 22, under the influence of the exterior magnetic field on a magnet mounted for rotation with the element. The magnet with its polar axis oriented to produce the desired magnetic orientation on the rotating element is designed to produce the desired (roughly opposite) orientations of the magnetic field. The magnet may be mounted on the rotating element in any desired manner. In the preferred embodiment the magnet 39 is made of magnetic rubberized material, such as Koroseal — B.F. Goodrich Compound 22 – 929 manufactured by Magnetics Inc. of 3000 Harris Avenue, Cincinatti, Ohio.

The ears 41 are provided with projections 49 extending axially relative to the element on each side of the aperture 43 and ending in bulbous extremities 51. To magnet 39 arranged to have its axis transverse to shaft 51 and transverse to the mean plane of the ring 40 and disc 42 is provided with apertures 53 to receive the bulbous extremities 51 but slightly smaller. The resilient rubber of the magnet is expanded to receive the bulbous extremities 51 and the reultant pressure of the magnet material on member 51 retains the magnet in position. The magnet is of course centrally apertured to allow free passage therethrough of the shaft 22.

In the preferred embodiment as previously described, the pivotal mounting element is the shaft 22 threaded through all the elements in a row. The ring 40 is shaped to mount a disc, both frame and disc usually but not necessarily circular. The disc 42 is constructed of resilient bendable material contrastingly coloured on opposite sides. The disc 42 before it is applied to the frame, (or ring 40 in the preferred embodiment) has a normal (unstressed) attitude. The ring 40 is designed to support the disc 42 in a stressed attitude. When the ring is resiliently bent the pressure exerted by the bias of the stressed disc on the frame is designed to cause, in combination with the frame on ring design, the mounting and retention of the disc on the frame.

The disc 42 may thus be simply bent from its normal attitude for application to the frame.

This arrangement has been found very efficient for assembly and economical of construction since the disc may be easily applied to the ring either before or after assembly of the frame on its pivotal mounting. Moreover the separate construction of the disc 42 and frame of the rotatable element allows convenient stamping or other multiple production technique of providing a large number of the discs, contrastingly coloured on opposite sides, from a large sheet of stock.

Preferably the disc 42 is flat in its normal attitude and is bent into a concave-convex shape (when viewed in one direction edgewise) for application to the frame. From the drawings and from the mode of construction it will be obvious that what is meant by concave-convex is such shape viewed edgewise along the bending line in the attitude of FIGS. 4 and 5, it being appreciated that the concave-convex shape is cylindrical as distinct from spherical as in a lens. Preferably the darker side 47 of the disc 42 is placed on the concave side so that the differential expansion caused by the heat of ambient radiation or illuminating light presses the bent disc 42 more firmly against the frame so that the differential expansion causes the disc 42 to be held in the frame more rather than less securely.

A bar 46 extends diametrically across the ring and tabs 48 are located inwardly extending from the ring and on each side of the bar 46.

The disc 42 is provided of resilient bendable material to be fitted inside the ring 44. The material for the disc 42 may be any material relatively easily bendable from its unstressed attitude and of the type when bent to try to return to its unstressed attitude. The preferred material is Mylar between 5 and 10 thousandths of an inch thick. The disc is shaped to fit inside the periphery of the ring 42 and to contact each of the tabs 48 when inserted with the disc on the side of the bar 46 remote from the intended location of the pivot axis and with the outer areas of the disc 42 bearing on the sides of the tabs 48 which are nearer to the rotational axis. In this way the tabs 48 and the bar 46 hold the disc in bent position so that the pressure of the disc attempting to straighten itself out on the tabs 48 and bar 46 holds the disc in position. Preferably the edges of the disc 42 approach sufficiently closely to the edge of the ring 4A so that the disc 42 cannot easily be displaced from under the tabs.

The arrangement allows stamping of large number of discs from a single flat sheet in a single or in a few operations. The discs 42, as well be obvious from the construction shown may easily be inserted into the frame or ring 44 before or after the pivotal mounting of the frame or ring. A disc 42 may easily be replaced. With the bar parallel to the intended pivotal axis and the disc 42 located on the opposite sides of the bar from such axis, the bar acts to space the disc from the pivot shaft 22 and avoid interference between the two.

The disc 42 contrastingly coloured on opposite sides will tend, under the heat generated by ambient or illuminating radiation to expand more on the darker side. Thus the disc 42 bent into concave-convex shape by the ring 44 is arranged with its darker side 47 shaped concavely so that such differential expansion will cause the disc 42 to attempt to straighten and bear more firmly on the tabs 48 and bar, more securely maintaining itself in position.

Figure 5:
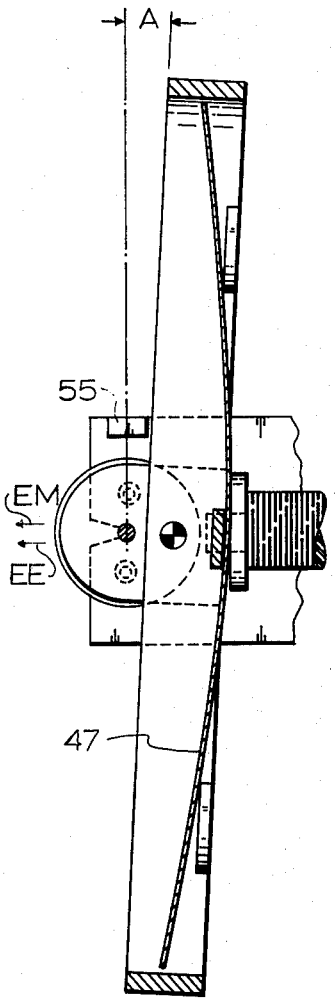
FIG. 5 shows the element of FIG. 4 rotated a little less than 180°.
Figure 4:
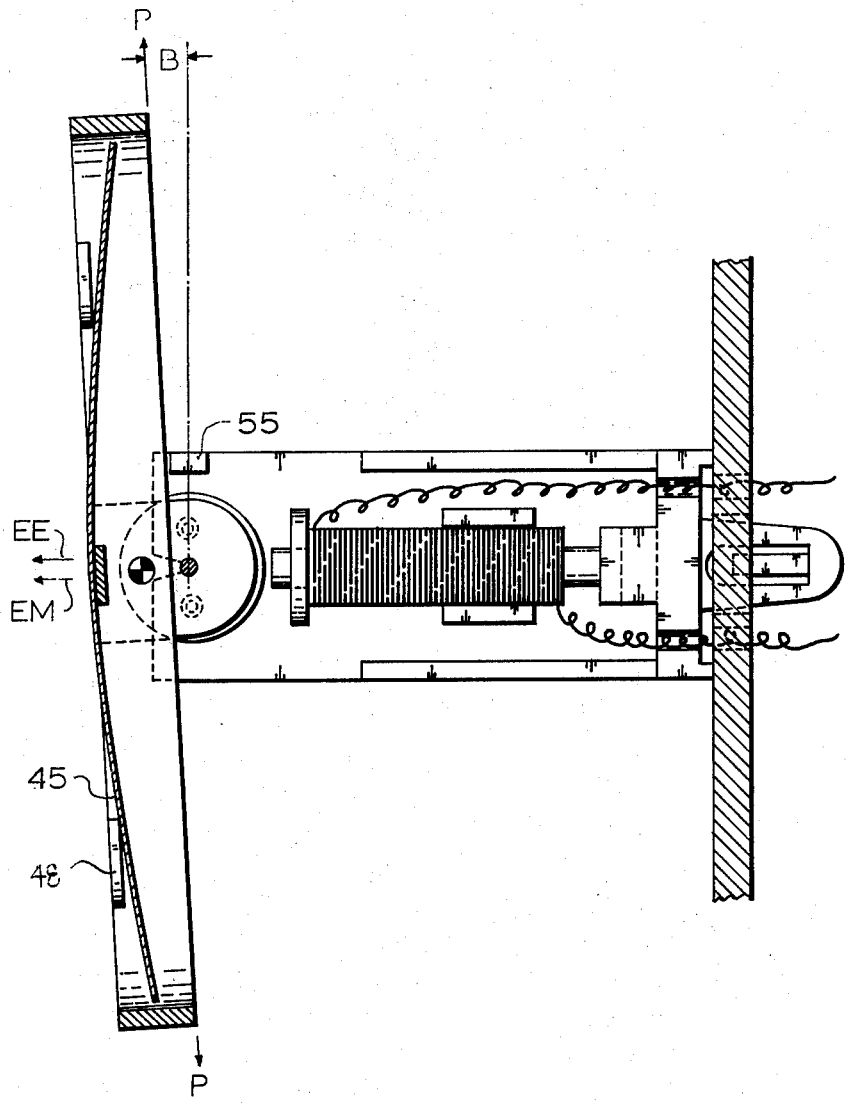
FIG. 4 shows a cross-section along the line 4—4 of FIG. 1.
Figure 6:
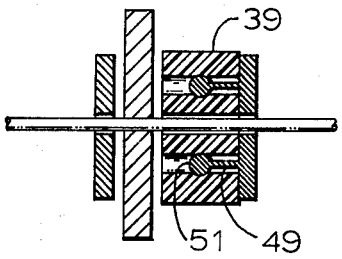
FIG. 6 shows the way that the magnet is mounted on the rotatable element.

With the preferred stressed attitude of the disc in a concave-convex shape, the form of the frame is preferably an open ring 44 with a bar 46 across the middle designed to bear on the disc 42 in one direction and tabs 48 about the outside to bear on the disc 42 in the other direction, whereby the tabs 48 and the bar 46 together produce the concave-convex shape of the disc 42. The pivot mounting is preferably a rod or shaft 22 extending across the ring 44 and generally parallel to the general attitude of the display surfaces 45 and 47 of the disc and approximately midway thereacross. The bar 46 of the ring 44 is located parallel to and spaced from the pivot rod or shaft 22 and the disc 42 is located as best shown in FIGS. 4 and 5 on the far side of the bar 46 from the pivot rod or shaft 22 so that the bar 46 acts to space the disc 42 from the pivot shaft 22 with the concave side 47 of the disc facing the shaft.

The drawings, see particularly FIG. 1, are shown with the lighter side of the disc 45 stippled and the darker side 47 clear. The reason for illustrating the array in this way is that it is customary to color the operational parts and the board the color of the darker side. Showing the darker side as 'clear' therefore leaves the array of FIG. 1 clear for the illustration of the parts.

In another aspect of the invention, the rotatable element and magnet, considered as an assembly or unit, are designed to have a centre of gravity (illustrated by the quartered circle of FIGS. 4 and 5) offset from the pivot axis, (represented by shaft 22) in a direction which has a horizontal component in both alternative orientations of the rotatable element. This results in the element, (as best shown in FIGS. 4 and 5) in each of its alternative orientations, assuming a position which is a resultant of the force exerted on the element by the external field and the force of gravity on the element. As illustrated in FIGS. 4 and 5 where the intended viewing direction of the device is horizontal and the general (i.e. average) orientation is in the plane of the ring, represented by the direction P of FIG. 4. As illustrated in FIGS. 4 and 5 therefore, the offset of the disc and ring from the vertical is angle A in the orientation of FIG. 5 and angle B in the orientation of FIG. 4. The result is that the element magnetic field EM is slightly misaligned from the exterior magnetic field EE in each alternative orientation and this misalignment removes any ambiguity in the direction of rotation when the direction of the exterior field is reversed.

The bracket 12 is preferably provided with a stop 55 to limit the free rotation of the rotatable element to just less than 180°. As best shown in FIGS. 4 and 5 the stop 55 does not inhibit movement of the element from one intended rest position to the other but does, on rotation of the element between positions act to limit the 'overshoot' and thus damp the settling of the device.

I claim:

1. Rotatable element for display or indicator comprising:

a peripheral ring, the locus of said ring approximately corresponding to a plane;

a pair of mounting ears projecting from said ring on opposite sides thereof;

said rings being arranged and apertured to define aligned holes to receive a shaft which is arranged to rotatably support said ring with said shaft generally parallel to the plane of said ring;

a longitudinally extending support member extending across said ring;

tabs extending inwardly from said ring on opposite sides of said support member; and said tabs and said support member being so arranged that a resilient disc contrastingly colored on opposite sides and shaped to be received inside said ring may be applied thereto and resiliently bent to contact said tabs on one side and said support member on the other side is bent into an arrangement which is concave-convex when viewed longitudinally relative to said support member and means for mounting on said ring a magnet, said support member and said disc being designed so that the contrasting faces of said disc may be viewed in a given direction in the roughly opposite orientations of said frame.

2. A rotatable element as claimed in claim 1, where the orientations of said support member and of said shaft as defined by said apertures are parallel and said tabs and said longitudinal members are arranged so that said disc will be supported in such concave-convex arrangement with said disc on the opposite side of said longitudinal member from said pivot rod.

3. A rotatable element as claimed in claim 1 where said contrasting sides are lighter and darker respectively and said disc is disposed on said ring so that the concave side is the darker.

4. A rotatable element as claimed in claim 2 where said disc is disposed on said ring so that the concave side is the darker.

5. A rotatable element for a display or indicator assembly comprising a resiliently bendable display disc of laminar form provided with opposite sides of contrasting appearance, a frame for supporting said disc provided with means to support said disc when bent from its normal attitude, said means for supporting said disc comprising a central member designed to limit movement of a central portion of said disc in one direction and members designed to contact the edge of said disc to deform it and support it when said central portion is supported by said central member;

means for mounting said frame on a pivotal mounting so that the pivotal axis thereof is located adjacent a median line of said disc material; and means for mounting on the assembly of said disc and said frame, a magnet oriented to have its magnetic polar axis transverse to said pivotal axis.

6. A rotatable element as claimed in claim 5 wherein said disc is designed to be substantially planar in its normal attitude and wherein said frame is designed to support said disc when bent into a form which is concave-convex when viewed in one direction edgewise of said disc.

7. A rotatable element as claimed in claim 6 wherein said contrasting sides are coloured to provide a lighter and a darker side and wherein said disc is arranged so that the concave side is the darker.

8. A rotatable element as claimed in claim 6 wherein said pivotal mounting is a pivot shaft on which said frame is mounted to revolve and said frame is arranged so that said concave-convex disc is concave toward said pivotal axis and said frame is provided with a member bearing on said disc and maintaining said disc spacing from such shaft.

9. In a display or indicator array including a plurality of pivotally mounted display elements arranged in rows and columns, wherein said display elements each mount a magnet for rotation therewith, with the magnetic axis extending transversely to the pivotal mounting axis, and means, corresponding to each element for providing a reversible magnetic field exterior to the rotatable element for maintaining the position of the rotatable elements in one of two roughly opposite orientations;

wherein each said rotatable element magnet defines a locus during the excursions of the rotatable element;

and said exterior field for each element is provided by a core projecting from at least one end of an energizing coil for said core which surrounds it;

means defining an aperture arranged to seat said one end of said core;

means for resiliently biasing said coil and core so that said core is seated in said aperture;

said aperture defining means and said resilient biasing means being located so that said one end of said core is located adjacent the locus of movement of said magnet.

* * * * *